US007798227B2

(12) United States Patent
Misselbrook

(10) Patent No.: US 7,798,227 B2
(45) Date of Patent: Sep. 21, 2010

(54) METHODS FOR PLACING MULTIPLE STAGE FRACTURES IN WELLBORES

(75) Inventor: John Gordon Misselbrook, Calgary (CA)

(73) Assignee: BJ Services Company LLC, Houston, TX (US)

( * ) Notice: Subject to any disclaimer, the term of this patent is extended or adjusted under 35 U.S.C. 154(b) by 58 days.

(21) Appl. No.: 12/341,723

(22) Filed: Dec. 22, 2008

(65) Prior Publication Data

US 2010/0155065 A1 Jun. 24, 2010

(51) Int. Cl.
*E21B 43/267* (2006.01)

(52) U.S. Cl. ..... 166/308.1; 166/280.2; 166/297

(58) Field of Classification Search ..... None
See application file for complete search history.

(56) References Cited

U.S. PATENT DOCUMENTS 5,417,284 A * 5/1995 Jones ..... 166/280.1
6,364,018 B1 4/2002 Brannon et al. ..... 166/280
6,772,838 B2 8/2004 Dawson et al. ..... 166/280
7,210,528 B1 5/2007 Brannon et ..... 166/280
2004/0040708 A1 3/2004 Stephenson et al. ..... 166/280.1
2006/0000620 A1 * 1/2006 Hamilton ..... 166/387
2008/0296019 A1 * 12/2008 Johnson et al. ..... 166/278
2009/0151938 A1 * 6/2009 Conkle et al. ..... 166/254.1

* cited by examiner

*Primary Examiner*—Zakiya W. Bates
(74) *Attorney, Agent, or Firm*—Howrey LLP

(57) ABSTRACT

A production tubing comprising a liner is placed downhole in a wellbore. A fluid pill containing proppant is squeezed into the annulus between the formation and liner, thereby packing the proppant into the annulus, effectively isolating the annulus. The packed proppant is permeable to liquids but impermeable to fracturing proppants. After isolation of the annulus, the wellbore may be perforated using a resettable perforation assembly. Once perforating is complete, the wellbore is fractured. The presence of the packed proppant in the annulus generates resistance to the flow of fracturing fluid along the annulus, forcing the fracture to propagate down the perforation tunnels, while also allowing subsequent production fluids to be produced along the annulus.

23 Claims, 7 Drawing Sheets

METHODS FOR PLACING MULTIPLE STAGE FRACTURES IN WELLBORES

BACKGROUND OF THE INVENTION

1. Field of the Invention

The present invention relates generally to the placement of fractures in wellbores and, more particularly, to a method of placing multiple stage fractures in an uncemented lined horizontal wellbore.

2. Description of the Related Art

Operators are increasingly completing horizontal wells in tight reservoirs where fracturing is required to achieve economic hydrocarbon production. Traditionally, these wells are completed with multiple fractures which are individually isolated along the wellbore during the fracturing process, by either cementing the liner in place or using external casing packers or other mechanical isolation methods.

There are a number of drawbacks to the conventional methods. First, cementing the annulus severely limits the production efficiency of the well because the cement prevents any matrix production into the wellbore from the unstimulated interval between the fractures. Second, the use of mechanical packers and the associated ball operated frac sleeves that provide communication through the liner adds significant cost to the wells.

Techniques to perform multiple fractures in the openhole have been developed to combat some of these problems. One commercially available method exploits the use of jetting tools, conveyed on coiled tubing, together with annular fracturing techniques. However, these fracturing techniques cannot eliminate fracture fluid leaking off to the induced fractures lower in the well and, oftentimes, it is unpredictable as to where the fluid is going and, thus, how the fracture is propagating. Moreover, this and other open hole techniques are accompanied by certain practical difficulties, such as differential sticking and packing of the proppant around the jetting tool. Also, using a liner alone without any annular flow containment mechanisms risks fluid traveling along the annulus and propagating along previous fractures.

In view of these drawbacks, there is a need in the art for an improved, less expensive method of completing wells, whereby placement of discrete fractures along the wellbore is allowed, while maintaining fluid communication along the annulus between the formation and any installed liner.

SUMMARY OF THE INVENTION

The present invention provides methods for placing multiple stage fractures in uncemented lined wellbores. The invention is particularly well-suited for horizontal or highly deviated wellbores. A production liner is placed downhole in a wellbore and a fluid pill containing lightweight proppant or other similar spherical material is displaced downhole through the liner, into an annulus surrounding the liner. Preferably, the proppant is an ultra-lightweight or neutrally buoyant material to facilitate placement along the length of a horizontal or highly deviated wellbore. The proppant slurry is then slowly squeezed and packed into the annulus, the filtrate of the fluid pill leaking off to the surrounding formation. The packed proppant is permeable to liquids but impermeable to fracturing proppants. The wellbore is then perforated using a perforating assembly which is adapted to be set and reset within the liner.

Once a section of the wellbore has been perforated, the wellbore is fractured and then isolated either by placing a proppant plug in the wellbore or by using a mechanical packer or plug. The perforating assembly is moved to another section of the wellbore, where perforating may be again commenced and fracturing can be repeated without the need to remove the perforating assembly from the wellbore. The packed proppant creates a porous material that prevents the fracturing treatment from traveling along the annulus and, instead, ensures the fluid enters the fracture in the formation adjacent to the perforations. The packed proppant subsequently allows formation fluids to be produced through the porous material. Thus, the packed proppant effectively isolates the annulus between the perforated sections during subsequent fracturing operations, yet permits the production of wellbore fluids through the annulus once the well is placed on production.

The foregoing summary is not intended to summarize each potential methodology or every aspect of the subject matter of the present disclosure. Other objects and features of the invention will become apparent from the following description with reference to the drawings.

Figure 1:
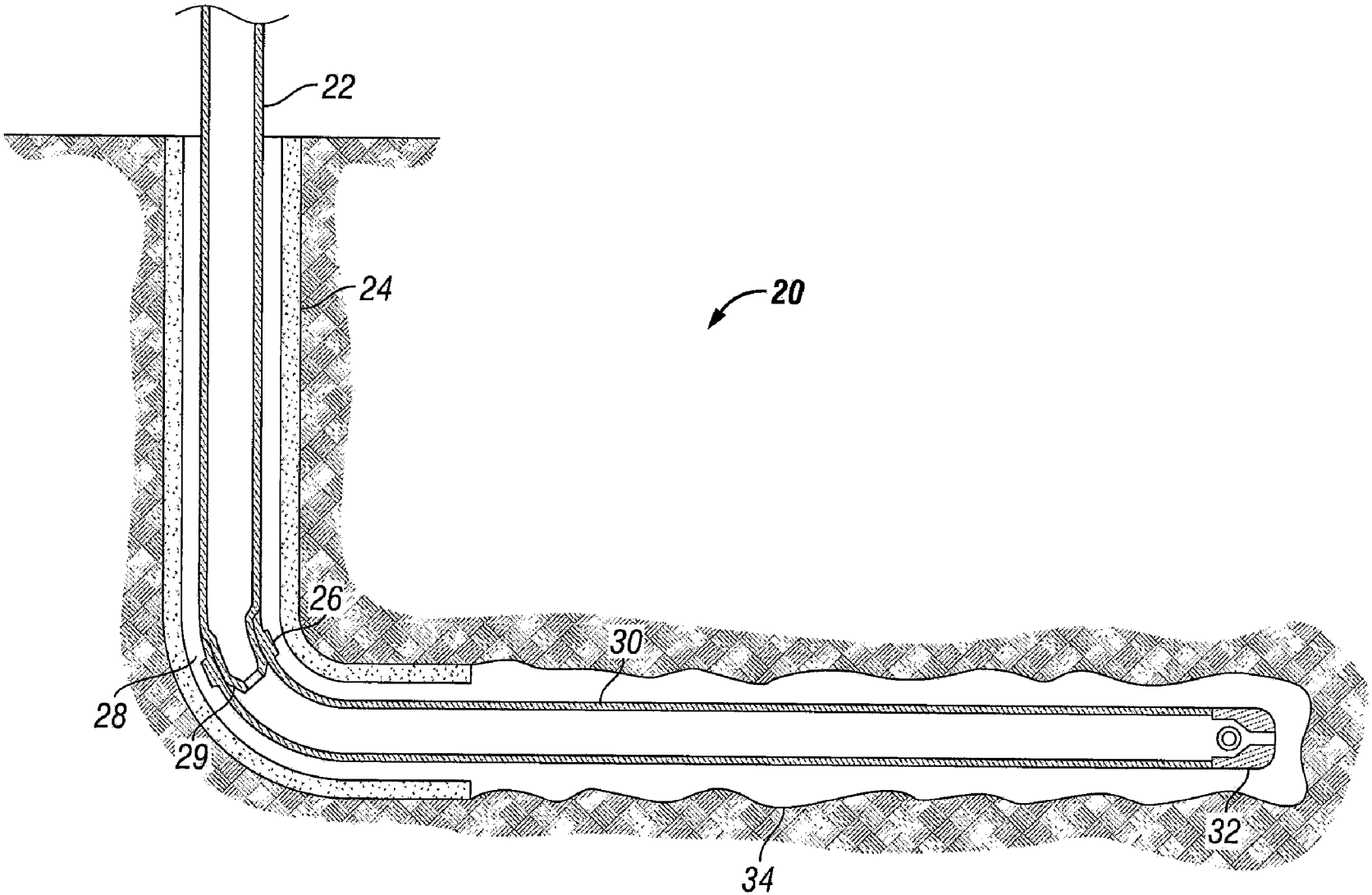
FIG. 1 illustrates the initial step of running a liner into the wellbore according to an exemplary method of the present invention.

While the invention is susceptible to various modifications and alternative forms, specific methods have been shown by way of example in the drawings and will be described in detail herein. However, it should be understood that the invention is not intended to be limited to the particular methods disclosed. Rather, the intention is to cover all modifications, equivalents and alternatives falling within the spirit and scope of the invention as defined by the appended claims.

DESCRIPTION OF THE ILLUSTRATIVE METHODS

Illustrative methods of the invention are described below as they might be employed in the use of a method for placing multiple stage fractures in an uncemented wellbore. In the interest of clarity, not all features of an actual implementation or method are described in this specification. It will of course be appreciated that in the development of any such actual embodiment or method, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Referring to FIG. 1, a horizontal or highly deviated wellbore 20 is illustrated having a drill pipe or workstring 22 extending downhole inside casing 24. A liner hanger 26, as known in the art, is placed within casing 24 at build section 28 of wellbore 20. A running tool 29 is used to land liner hanger 26 and those ordinarily skilled in the art having the benefit of this disclosure realize there are a variety of running tools and/or hangers could be utilized. Commercially available liner hangers, such as a TIW Hydraulically Set Top Packer and other comparable models, are well-suited for use with the present invention. However, those ordinarily skilled in the art having the benefit of this disclosure realize other liner hangers could also be used.

A liner 30 is hung beneath liner hanger 26 and extends down past casing 24 and into the open rock formation. In a preferred embodiment, hanger 26 is a hydraulically set hanger. A shoe 32 is located at the bottom of liner 30 and includes a one-way check valve that prevents annular fluids from flowing into the liner 30. The operation of shoe 32 is well known in the art.

Figure 2:
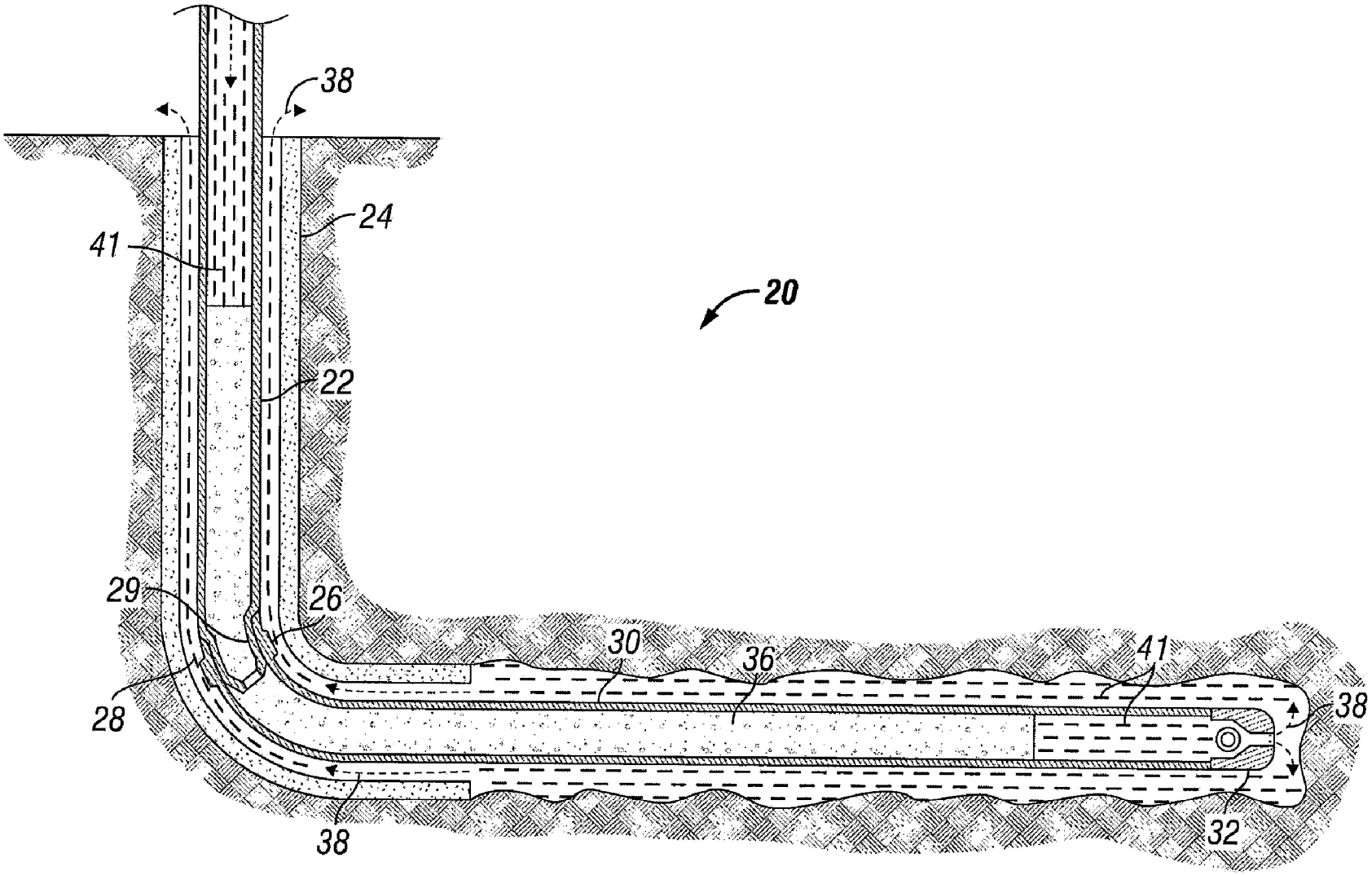
FIG. 2 illustrates the second step of displacing a fluid pill down the drill pipe according to an exemplary method of the present invention.
Figure 3:
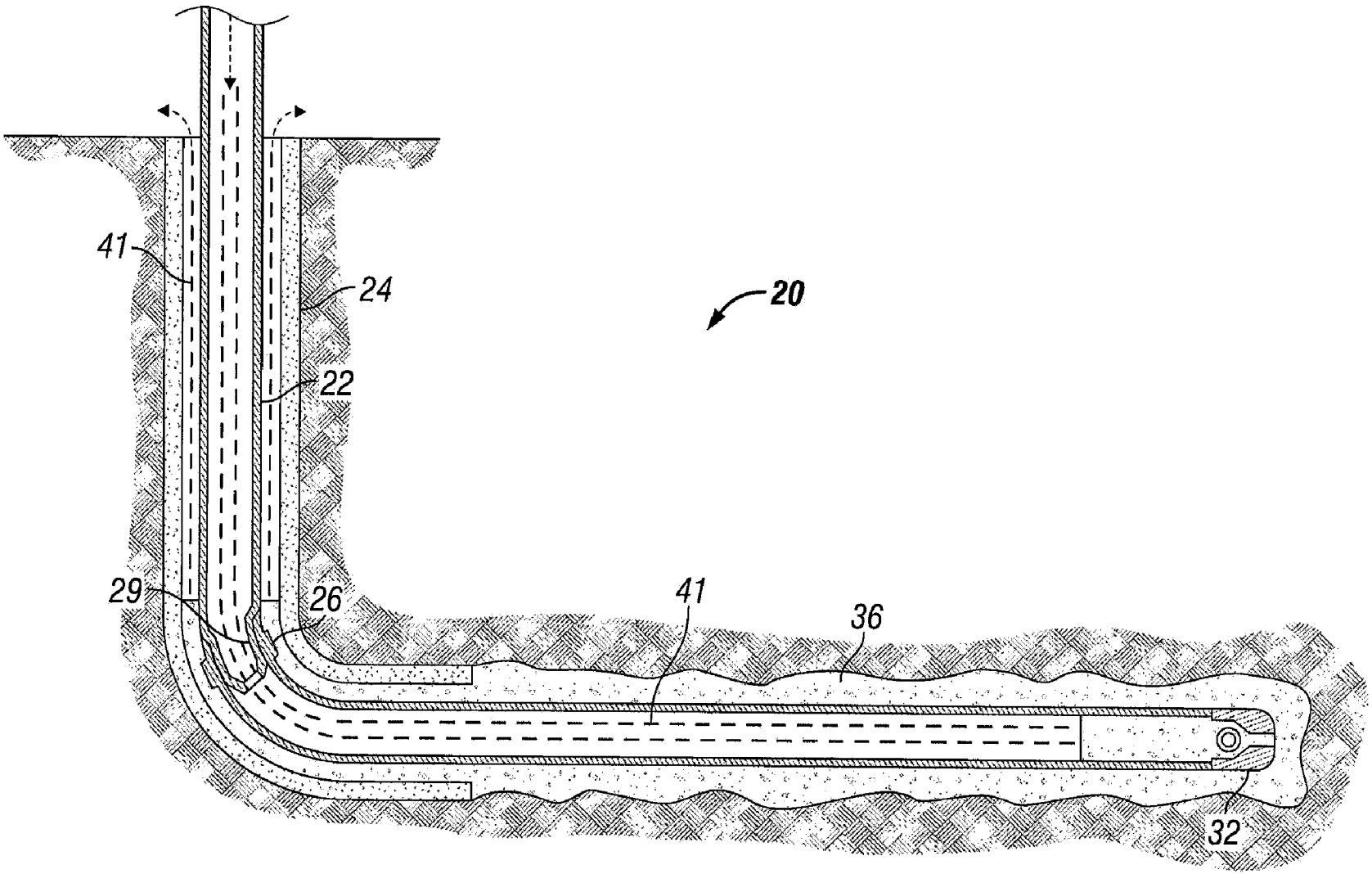
FIG. 3 illustrates the third step of equalizing the volume of the fluid pill in the liner and annulus above the liner according to an exemplary method of the present invention.

Referring to FIGS. 1-7, an exemplary method according to the present invention will now be described. First, as illustrated in FIG. 1, liner hanger 26, liner 30 and shoe 32 are run into wellbore 20 to the desired depth using drillpipe 22. Once assembled and landed, an annular open hole area 34 is created between liner 30 and the rock formation. Second, as illustrated in FIG. 2, a fluid pill 36, containing a proppant ladened slurry, is displaced down into drillpipe 22. In a preferred embodiment, fluid pill 36 contains 40% proppant and 60% fluid, although other combinations may be used. Those ordinarily skilled in the art having the benefit of this disclosure realize the amount of proppant utilized can be varied depending upon downhole conditions.

In this exemplary embodiment, the volume of slurry used in fill fluid pill 36 is calculated to fill annular open hole area 34, including enough excess volume to allow for complete dehydration of the slurry in the annulus, such that after the proppant has been packed off, as will be discussed later, annular open hole area 34 is packed fall of proppant. In a preferred embodiment, the volume of slurry pumped is calculated based upon the solid/liquid concentration in fluid pill 36 and the max stacking density of the proppant particles. Such calculations are well known in the art. For example, if the slurry contains a 50/50 mixture and the proppant is perfectly spherical and of identical size (i.e., max stacking density 75%), the dehydrated fluid pill will occupy 66.6% (i.e., 50/0.75) of the volume of the original fluid pill. Therefore, in order to fill a prescribed space, fluid pill 36 would require 50% (i.e., 100/66.6) more fluid pill volume than the space being filled with fluid pill 36. Please note, however, those ordinarily skilled in the art having the benefit of this disclosure realize there are a variety of methods by which to calculate the volume of slurry needed for a given wellbore.

The proppant of fluid pill 36 contains characteristics such that, once it has been packed off (as will be discussed later), it is permeable to fluids but impermeable to fracturing proppants. For purposes of this disclosure, the term "proppant" refers to a lightweight proppant, ultra lightweight proppant, neutrally buoyant proppant or mixtures of such proppants or proppant slurries, such as, for example, those disclosed in U.S. Patent Publication No. 2004/0040708, entitled "METHOD OF TREATING SUBTERRANEAN FORMATIONS WITH POROUS CERAMIC PARTICULATE MATERIALS," filed on Sep. 2, 2003; U.S. Pat. No. 6,772,838, entitled "LIGHTWEIGHT PARTICULATE MATERIALS AND USES THEREFOR," issued on Aug. 10, 2004; U.S. Pat. No. 6,364,018, entitled "LIGHTWEIGHT METHODS AND COMPOSITIONS FOR WELL TREATING," issued on Apr. 2, 2007; and U.S. Pat. No. 7,210,528, entitled "METHOD OF TREATMENT SUBTERRANEAN FORMATIONS USING MULTIPLE PROPPANT STAGES OR MIXED PROPPANTS," issued on May 1, 2007, each being owned by BJ Services Company of Houston, Tex. and are hereby incorporated by reference in their entirety. As disclosed therein, the ultra lightweight proppant, neutrally buoyant proppant or ultra lightweight proppant mixture is capable of remaining substantially suspended and/or suspended within fluid pill 36 under both static and dynamic flowing conditions.

Further referring to FIG. 2, as fluid pill 36 is displaced down drillpipe 22, drilling mud and/or completion fluid 41 is forced out of liner 30 via shoe 32 and out into annular open hole area 34. Shoe 32 operates to allow fluid flow out into open hole area 34, while preventing fluid flow back uphole through liner 30. Drilling mud 41 is displaced uphole and through wellbore 20 as understood in the art. Fluid pill 36 continues to be displaced downhole, eventually reaching shoe 32 where it begins to flow out into annular open hole area 34 and back up past liner hanger 26 toward build section 28 as indicated by arrows 38. As mentioned earlier, the make-up of shoe 32 is well known in the art.

In the most preferred embodiment, fluid pill 36 continues to be displaced until the volume of fluid pill 36 within liner 30 is equal or substantially equal to the volume of fluid pill 36 in the annulus between casing 24 and drillpipe 22 (i.e., the annulus above liner 30). In the most preferred embodiment, a range of deviation between the volumes may be, for example, +/−10%. These volumes are readily calculated based on the hole size, the inner and outer diameter of the liner and the clearance between drill pipe 22 and casing 24, as understood in the art.

Figure 4:
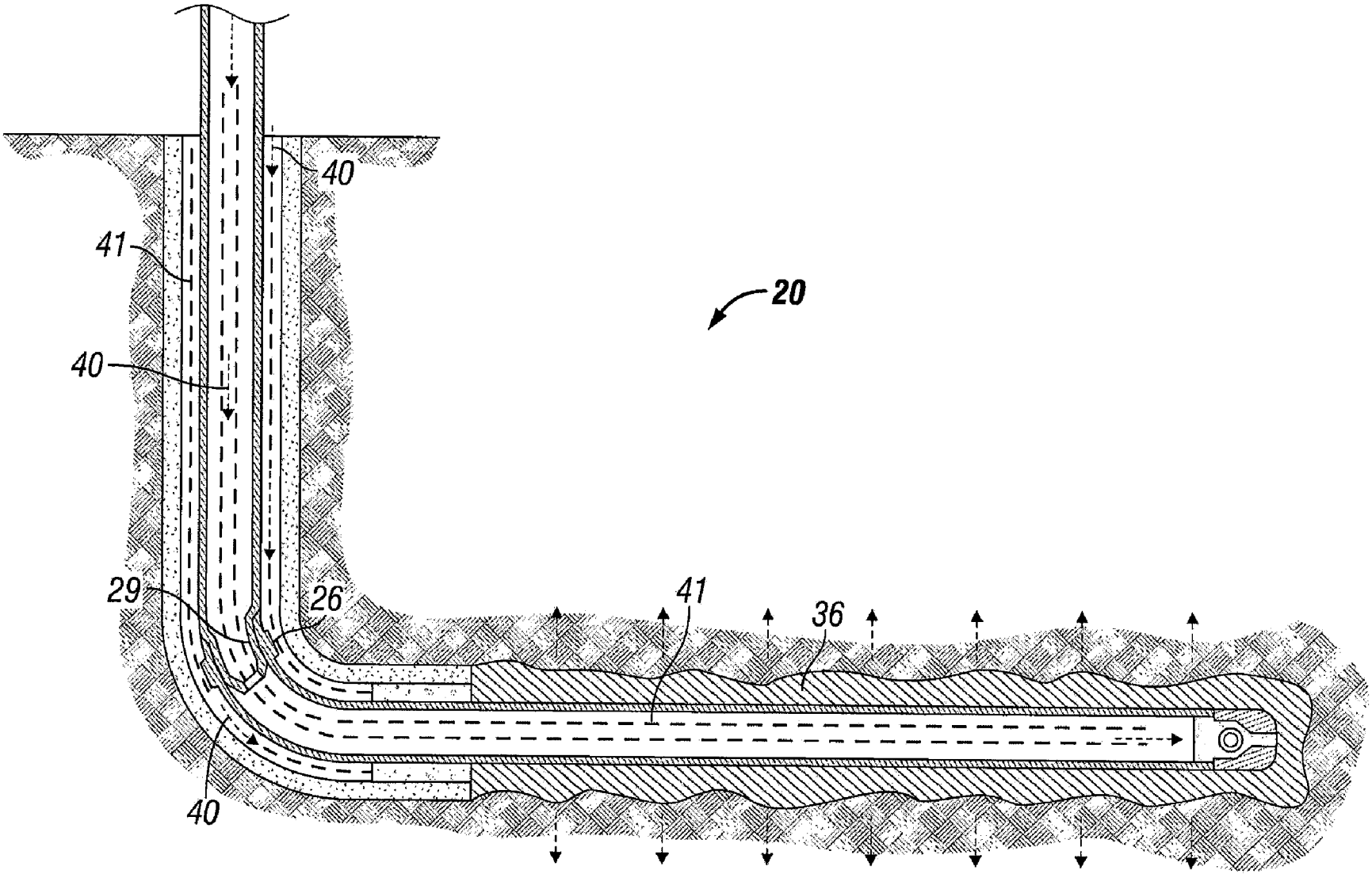
FIG. 4 illustrates the fourth step of dehydrating the fluid pill within the annular open hole area.

Thereafter, referring to FIG. 4, fluid pressure is slowly applied down drill pipe 22 and casing 24, as shown by arrows 40. In a preferred embodiment, the fluid pressure is applied at equal displacement rates down pipe 22 and casing 24. This fluid pressure is transmitted through fluid pill 36, forcing filtrate out of the proppant fluid pill 36 and into the formation. "Breakers" may be mixed in the proppant slurry in order to encourage the dissolution of drilling mud filter cake buildup, to encourage the dehydration of the proppant fluid pill and to improve the solid concentration in the annular open flow area 34. In an exemplary alternative embodiment, however, fluid pill 36 is not over displaced out of the liner; rather, instead, fluid pill 36 is displaced into liner 30 and fluid pressure is applied down drill pipe 22 and down liner 30, thereby packing the proppant in fluid pill 36 into annular open hole area 34 from the bottom of the wellbore.

After the pressure has been applied to fluid pill 36, the slurry within fluid pill 36 is dehydrated within annular open flow area 34, effectively "packing" the proppant of fluid pill 36 within annular open hole area 34. This "packing" effectively isolates open hole area 34 during subsequent frac stimulations, while still allowing fluids to be produced due to the permeability of the proppant pack. In the most preferred embodiment, this fluid pressure slowly squeezing fluid pill 36 is accomplished by pumping the fluid at a pressure below the fracture gradient of the open hole section of wellbore 20. Fluid pressure is continued until the volume of the liquid pumped equals the volume of fluid pill 36 minus the actual volume of the proppant. The volume and squeeze pressure can be calculated and monitored using methods known in the art. At that point, the proppant has reached its maximum stacking density and further pumping is just squeezing liquid through the porous proppant pack. This "squeezing" action is only possible if the rock formation has some permeability to allow liquid flow therein. A suitable permeability would be, for example, at least 1 milli-darcy.

Ideally, the carrier fluid in fluid pill 36 will have the lowest viscosity possible consistent with maintaining the proppant in suspension, thereby encouraging leak-off (i.e., dehydration) of the slurry in the open hole area 34. The leak-off rate to the formation is a function of the formation permeability: so the higher the formation's permeability, the higher the viscosity of the fluid which may be utilized. In a preferred embodiment, fluid pill 36 is comprised of water as the carrier fluid and neutrally buoyant proppant of a density similar to that of treated water suitable for completion operations. In the alternative, for example, an ultra-lightweight proppant could be used along with medium weight brine in order to achieve effective buoyancy. However, if turbulent flow conditions in the annulus are achievable, lower density brine could be used instead. Generally, the use of viscosity to help suspend lightweight proppant would only be used in situations where circulation rates were too low to maintain suspension of the proppant, but the formation had enough permeability not to significantly reduce fluid leak-off resulting form the increase in viscosity (Note: for Darcy radial flow, the fluid leak off is inversely proportional to the fluid viscosity, i.e., double the viscosity and you cut the leak-off rate in half).

In embodiments utilizing neutrally buoyant proppant, viscosity would not be a factor. However, in embodiments utilizing ultra-light weight proppant, under some circumstances a combination of density and slight viscosity in the carrier fluid may be necessary for adequate proppant transport along the open hole/liner annulus. Optimizing this combination of fluid density and viscosity would be dependent upon a variety of factors, such as, for example, the length of the horizontal well, the formation's compatibility with water or brine carrier fluid, the geometry of the openhole/liner annulus, and the fracture gradient of the formation. Those ordinarily skilled in the art having the benefit of this disclosure realize that such calculations could readily be determined using known methods.

Figure 5:
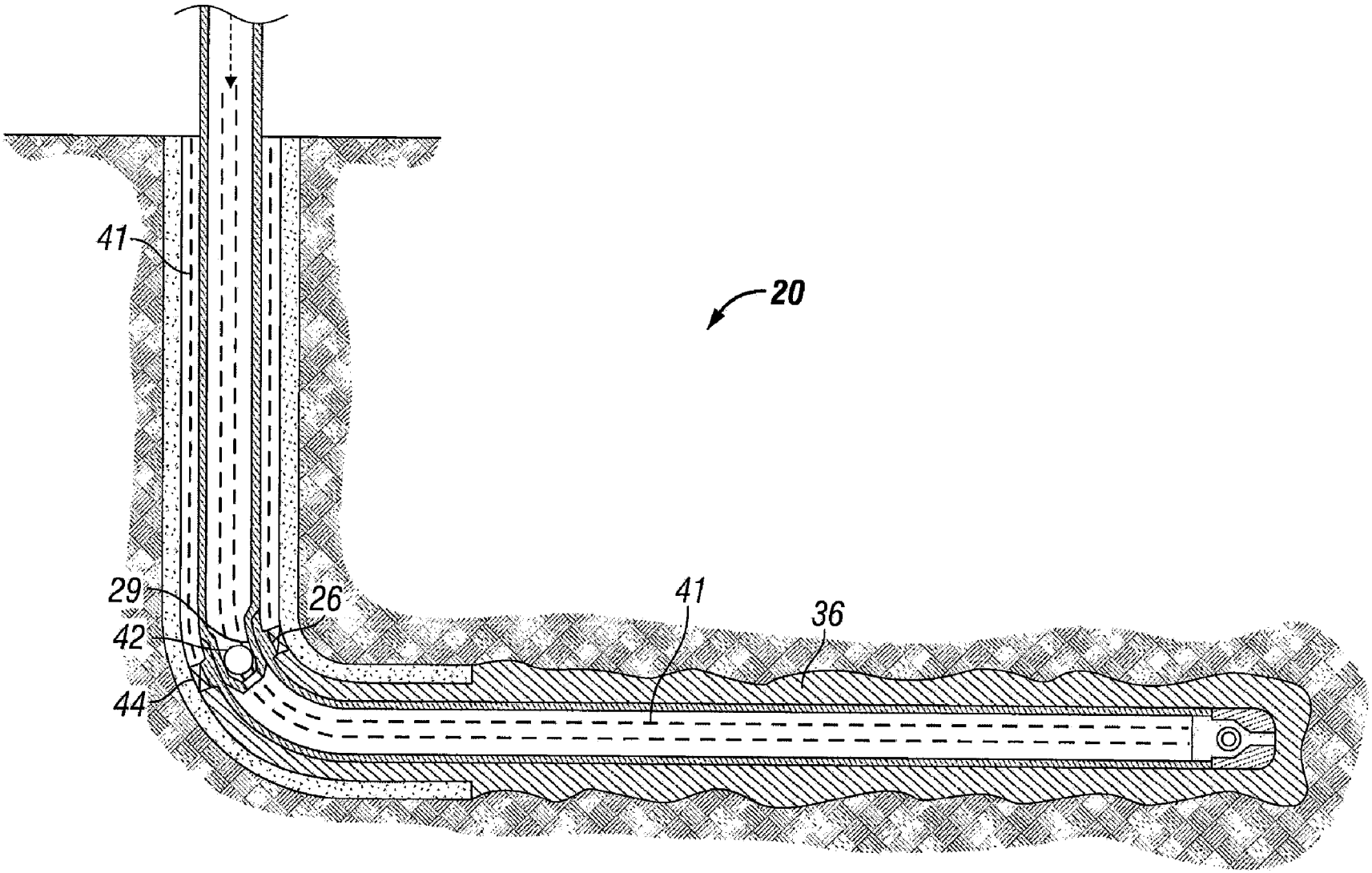
FIG. 5 illustrates the fifth step of setting a liner hanger and pack-off according to an exemplary method of the present invention.

Referring to FIG. 5, after fluid pill 36 has been dehydrated, liner hanger 26 and the related pack-off 44 are set. Drop ball 42 is dropped into the drill pipe 22 and, after the ball 42 has landed on a mating ball seat in the hanger 26, pressure is applied to the drill pipe 22 to hydraulically set the hanger 26 as known in the art. Those skilled in the art having the benefit of this disclosure recognize that other types of known hangers may be used with the present invention. In the preferred embodiment, hanger 26 is placed at a positive angle along the build section 28 to allow drop ball 42 to gravitate to the ball seat.

Figure 6:
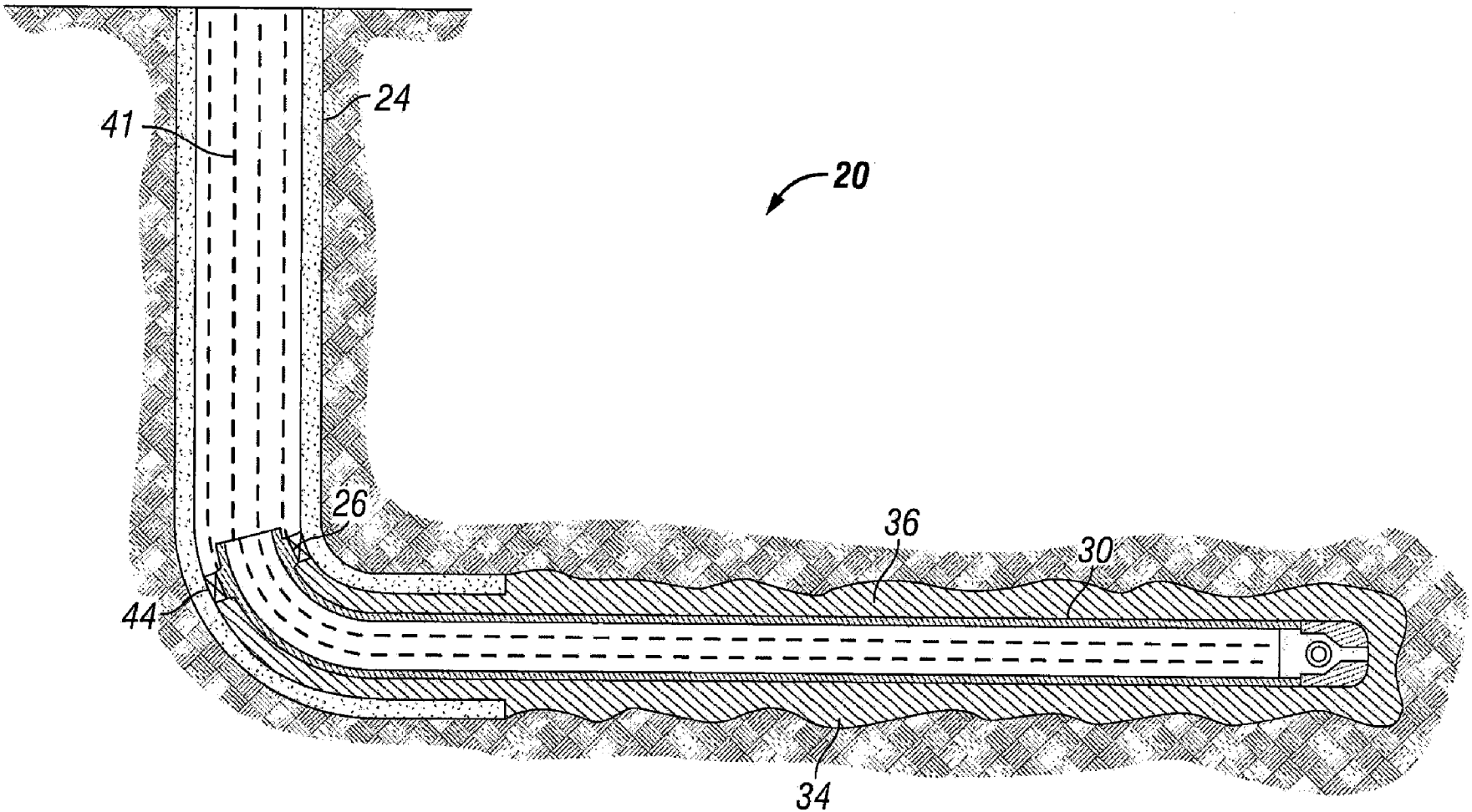
FIG. 6 illustrates the sixth step of disengaging and removal of the running tool for the hanger and pack-off according to an exemplary method of the present invention.

A pack-off 44 of the liner hanger 26 is expanded in the annular area between hanger 26 and casing 24 to seal off the open hole area 34 below hanger 26. Once pack-off 44 is set, the liner hanger running tool is disengaged and pulled out of wellbore 20 along with drill pipe 22 as shown in FIG. 6. Accordingly, the annular open hole area 34 has been packed fill of the proppant which, when packed, is permeable to liquids but impermeable to fracture proppants.

Figure 7:
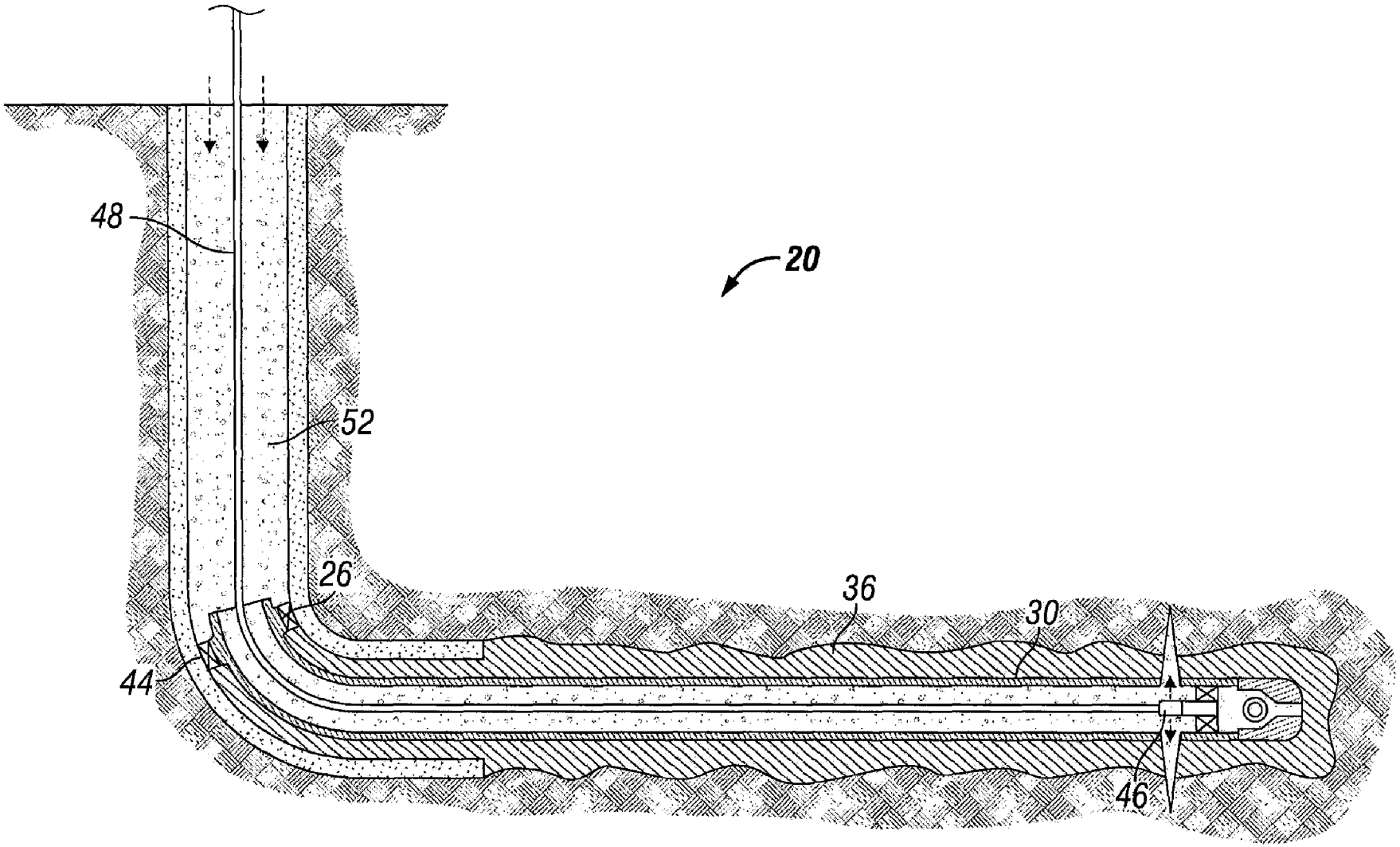
FIG. 7 illustrates the seventh step of perforating a zone within the wellbore according to an exemplary method of the present invention.

Referring to FIG. 7, wellbore 20 is now ready to be perforated and fractured. A perforating assembly 46 is run downhole inside liner 30 on a work string 48. Perforating assembly 46 comprises a perforating gun and a resettable pack-off tool 50 used to seal the annular area between the perforating assembly 46 and liner 30 beneath perforating assembly 46. Resettable pack-off tool 50 could be, for example, an OptiFrac SureSet™ tool commercially available from BJ Services Company of Houston, Tex.

After the pack-off tool 50 is set, perforating assembly 46 is then used to perforate liner 30 and the adjacent rock formation through the packed proppant. After perforating is complete, fracturing fluid 52 is displaced down the annulus between the workstring and casing 24/liner 30 to hydraulically fracture the formation as understood in the art. The perforating process will weaken the formation opposite the perforations and the fracture "pad" will preferentially propagate a fracture at this location. Any fluid leak off from the pad along the annulus and through the packed proppant of fluid pill 36 will be subject to friction pressure losses, resulting in a progressively lower fluid pressure along the annulus and limiting its ability to create fractures elsewhere. The leak-off of "pad" fluid thru' the packed proppant of fluid pill 36 is further controlled by the rheological properties of the "pad" fluid. Because the packed proppant of fluid pill 36 is impermeable to the proppant in the fracturing fluid 52, fracturing fluid 52 does not enter annular open hole area 34 (i.e., fluid 52 does not flow axially along area 34), and, is thereby forced into the already initiated fracture. However, since the packed proppant of fluid pill 36 is permeable to fluids, the wellbore fluids that subsequently flow into open annular area 34 from the rock formation are still allowed to be produced through the packed proppant.

Once fracturing of this section of liner 30 is complete, resettable pack-off tool 50 of perforating assembly 46 is disengaged from the inner diameter of liner 30. Perforating assembly 46 is then moved uphole and resettable pack-off tool 50 is reset, isolating the lower section of perforations which were previously stimulated. In a preferred embodiment, the lower perforations can be isolated with a CT conveyed isolation device, such as the OptiFrac SureSet™ tool offered commercially by BJ Services Company. This section could alternatively be isolated using either a sand or proppant plug or a composite bridge plug (not shown).

After perforation of this section is complete, fracturing fluid 52 is again displaced downhole, passing through the perforations in liner 30, and propagating into the perforated rock tunnels, to fracture this section of the wellbore. This process is repeated as desired. After all sections have been perforated and fractured, a final perforating run can be made if desired, preferably using select fire guns, and additional communication with the unstimulated sections of the matrix behind the liner and between the fractures can be established.

Accordingly, the present invention allows for perforating and fracture simulation of the wellbore in multiple locations, without requiring the liner to be cemented in place or be equipped with mechanical isolation devices. The invention is conducive to multi-stage fracturing methodologies that allow virtually continuous pumping, and includes methods where perforating assembly 46 need not be removed from the wellbore between stimulations. However, those of ordinary skill having the benefit of this disclosure will realize that perforating assembly 46 may be removed if desired.

An alternative embodiment of the present invention includes running a straddle packer assembly on larger diameter coiled tubing in order to pump the fracturing fluid down the coiled tubing instead of down the backside as described above. The assembly would include a pair of straddle packers sandwiched around a circulating sub with one or more ports extending therethrough. Perforating guns would extend beneath the lower packer. When a desired zone is to be perforated, the guns are positioned at the desired location. Following perforation of the liner, the packers are positioned so that the wellbore will be isolated above and below the perforations once the packers are set. Appropriate spacers may be located in the assembly to space the packers apart to straddle the longest anticipated length of the sections to be perforated as known in the art.

Further describing this alternative embodiment, once the packers are set, the fracturing fluid is pumped down the coiled tubing work string, out the circulating sub and into the perforation tunnels. Once the frac treatment is completed, the packers are released and the assembly is moved uphole to the next zone to be perforated and fractured, where the above process is repeated. Thus, multiple zones can be treated in a single trip into the wellbore. Coiled tubing suitable for such operations include might typically be 2⅜" or 2⅞" in diameter.

An exemplary embodiment of the present invention includes a method for placing fractures in a wellbore. The method comprises the steps of running a production liner downhole into the wellbore; displacing a fluid pill downhole through the liner, the fluid pill containing a proppant; displacing a portion of the fluid pill out of the liner and into an annular open hole area between the liner and the wellbore, the displacing continuing until the volumes of the fluid pill in the liner and in the annulus above the liner are substantially equal; packing the proppant in the fluid pill to fill the annular open hole area to isolate the annular open hole area surrounding the liner; perforating a first section of the wellbore using a perforation assembly positioned inside the liner; hydraulically fracturing the first section; moving the perforation assembly uphole; perforating a second section of the wellbore using the perforation assembly; and hydraulically fracturing the second section. The steps of moving the perforation assembly uphole and perforating and fracturing additional zones may be repeated as desired.

The exemplary method may further include the step of isolating the liner beneath the perforations to be fractured using a proppant plug or a resettable pack-off in the perforation assembly. Another exemplary embodiment may include the step of at least substantially suspending proppant in the annular open hole area. Yet another exemplary method may include the step of applying pressure to the fluid pill in order to dehydrate the fluid pill, the pressure being below the fracture gradient of the openhole section of the wellbore.

The exemplary method may further include displacing fracturing fluid into the perforations in the uncemented wellbore, the packed proppant substantially preventing the fracturing fluid from flowing axially along the annular open hole area. Yet another exemplary method further includes the step of producing fluids through the packed proppant within the annular open hole area.

Accordingly, the present invention allows placement of discrete fractures along a horizontal or highly deviated wellbore while maintaining fluid production from the formation between the fractures. As such, the present invention offers advantages over prior art cementing methods. Moreover, the resettable pack-off ability of present invention increases the efficiency of multiple fracture stimulation treatments in a horizontal or highly deviated wellbore because the operator is not required to remove the perforation assembly out from the wellbore and redeploy each time a section of perforations is completed. The present invention is also a cheaper alternative to the more expensive method of running external packing devices on the liner.

Although various methods have been shown and described, the invention is not so limited and will be understood to include all such modifications and variations as would be apparent to one skilled in the art. Accordingly, the invention is not to be restricted except in light of the attached claims and their equivalents.

The invention claimed is:

1. A method for placing fractures in a wellbore, the method comprising the steps of:

(a) running a production liner into the wellbore;

(b) displacing a fluid pill downhole through the liner, the fluid pill containing proppant;

(c) displacing a portion of the fluid pill out of the liner and into an annular open hole area between the liner and the wellbore, the displacing continuing until a volume of the fluid pill in the liner is substantially equal to a volume of the fluid pill in an annulus above the liner;

(d) packing the proppant in the fluid pill into the annular open hole area and isolating the annular open hole area surrounding the liner with the packed proppant;

(e) perforating a first section of the wellbore using a perforation assembly positioned inside the liner;

(f) hydraulically fracturing the first section;

(g) moving the perforation assembly uphole;

(h) perforating a second section of the wellbore using the perforation assembly; and (i) hydraulically fracturing the second section.

2. A method as defined in claim 1, wherein step (f) further comprises isolating the liner beneath the perforations to be fractured using a proppant plug or a resettable pack-off in the perforation assembly.

3. A method as defined in claim 1, wherein step (c) further comprises at least substantially suspending the proppant in the annular open hole area.

4. A method as defined in claim 1, wherein step (d) comprises dehydrating the fluid pill within the annular open hole area.

5. A method as defined in claim 4, wherein step (d) further comprises applying pressure to the fluid pill in order to dehydrate the fluid pill, the pressure being below a fracture gradient.

6. A method as defined in claim 5, wherein the pressure is applied by pumping fluid down a drill pipe and casing at an equal pump rate.

7. A method as defined in claim 1, wherein the steps of hydraulically fracturing the first and second sections comprises the step of displacing fracturing fluid into the perforations in the wellbore, the packed proppant in the annular open hole area substantially preventing the fracturing fluid from flowing axially along the annular open hole area.

8. A method as defined in claim 1, the method further comprising the step of producing fluids through the packed proppant of the fluid pill within the annular open hole area.

9. A method as defined in claim 1, wherein step (b) further comprises the step of inserting at least one of a lightweight proppant, an ultra lightweight proppant, or a neutrally buoyant proppant into the proppant of the fluid pill.

10. A method for placing fractures in a wellbore, the method comprising the steps of:

(a) running a production liner into the wellbore;

(b) displacing a fluid pill containing proppant downhole to the liner;

(c) displacing a portion of the fluid pill into an annular open hole area of the wellbore;

(d) packing the proppant in the fluid pill in the annular open hole area;

(e) perforating the liner; and (f) fracturing the wellbore through the perforations.

11. A method as defined in claim 10, wherein step (e) comprises the step of perforating the wellbore using a perforating assembly, the perforating being accomplished without removing the perforating assembly from the wellbore.

12. A method as defined in claim 10, wherein step (c) comprises displacing the fluid pill such that a volume of the fluid pill in the liner is substantially equal to a volume of the fluid pill in an annulus above the liner.

13. A method as defined in claim 10, the method further comprising the steps of:

(a) moving the perforating assembly to a second section of the wellbore;

(b) perforating a second section of the wellbore; and (c) fracturing the second section of the wellbore.

14. A method as defined in claim 10, wherein step (d) further comprises dehydrating the fluid pill.

15. A method as defined in claim 10, the method further comprising the step of producing fluids through the packed proppant.

16. A method as defined in claim 15, the method further comprising the step of substantially preventing fracturing fluid from entering the packed proppant within the annular open hole area.

17. A method as defined in claim 10, wherein step (b) further comprises the step of inserting at least one of a lightweight proppant, an ultra lightweight proppant, or a neutrally buoyant proppant into the proppant of the fluid pill.

18. A method for placing fractures in a wellbore, the method comprising the steps of:

(a) running a production liner into the wellbore;

(b) displacing proppant into an annulus surrounding the liner;

(c) isolating the annulus using the proppant;

(d) perforating the liner; and (e) fracturing the wellbore.

19. A method as defined in claim 18, wherein step (d) further comprises perforating the wellbore using a perforating assembly without removing the perforating assembly between stimulations.

20. A method as defined in claim 18, the method further comprising the step of producing fluids through the proppant within the annulus.

21. A method as defined in claim 20, the method further comprising the step of substantially preventing fracturing fluid from entering the proppant used to isolate the annulus.

22. A method as defined in claim 18, wherein the annulus is isolated by applying pressure down the liner and annulus, thereby packing the proppant into the annulus.

23. A method as defined in claim 18, wherein step (b) further comprises the step of inserting at least one of a lightweight proppant, an ultra lightweight proppant, or a neutrally buoyant proppant into the proppant being displaced into the annulus.

* * * * *